US008349430B2

(12) United States Patent
Toy

(10) Patent No.: US 8,349,430 B2
(45) Date of Patent: Jan. 8, 2013

(54) PADDING SYSTEM FOR PROTECTING A HOME APPLIANCE

(75) Inventor: Anthony Shee Toy, Niles, IL (US)

(73) Assignee: Sears Brands, L.L.C., Hoffman Estates, IL (US)

( * ) Notice: Subject to any disclaimer, the term of this patent is extended or adjusted under 35 U.S.C. 154(b) by 305 days.

(21) Appl. No.: 12/778,269

(22) Filed: May 12, 2010

(65) Prior Publication Data

US 2011/0281059 A1 Nov. 17, 2011

(51) Int. Cl.
*B32B 3/06* (2006.01)
*B32B 3/08* (2006.01)
*B32B 3/10* (2006.01)

(52) U.S. Cl. ..... 428/100; 428/99; 428/136

(58) Field of Classification Search ..... 428/100, 428/136; 150/165, 154
See application file for complete search history.

(56) References Cited

U.S. PATENT DOCUMENTS

2007/0282232 A1* 12/2007 Hoffman ..... 602/5
2008/0190806 A1 8/2008 Shin

* cited by examiner

*Primary Examiner* — Alexander Thomas
(74) *Attorney, Agent, or Firm* — McAndrews, Held & Malloy, Ltd.

(57) ABSTRACT

A padding system for protecting an outer surface of an appliance. The padding system includes a securing device that is attached to opposed first and second ends of a pad. The securing device consists of a first securing member that is releasably attachable to a second securing member when the pad is secured around the outer surface of the appliance. The padding system additionally includes a hand strap that is attached to the first end of the pad. A slit is formed in the pad adjacent to the second end of the pad. The hand strap is passable through the slit to provide a hand grip when the pad is secured around the outer surface of the appliance.

12 Claims, 2 Drawing Sheets

PADDING SYSTEM FOR PROTECTING A HOME APPLIANCE

BACKGROUND

Padding systems for use in protecting a home appliance, e.g., to prevent an outer surface of an appliance being moved from being indented and/or scratched, are known in the art. By way of example only, U.S. Published Application No. 2008/0190806, entitled "Protection Pad For Home Appliances" and incorporated herein by reference in its entirety, describes a padding system that includes at least two flat protection plates of predetermined size, a connection unit for connecting the protection plates to each other so that various angles can be defined between the protection plates, and magnets provided in the protection plates so that the protection plates can be attached to an outer surface of a home appliance. Each of the protection plates has a plate-shaped core with predetermined hardness and a cover for enclosing the core.

While the use of such known padding systems do help prevent damage to an outer surface of a home appliance when the home appliance is being moved in an unpacked state, a need remains for an improved padding system.

SUMMARY

An improved padding system for protecting a home appliance is hereinafter described. More particularly, the padding system includes a securing device that is attached to opposed first and second ends of a pad. The securing device consists of a first securing member that is releasably attachable to a second securing member when the pad is secured around the outer surface of the appliance. The padding system additionally includes a hand strap that is attached to the first end of the pad. The pad is provided with a slit that is positioned adjacent to the second end of the pad. The hand strap is passable through the slit to provide a hand grip when the pad is secured around the outer surface of the appliance.

A better understanding of the objects, advantages, features, properties and relationships of the improved padding system will be obtained from the following detailed description and accompanying drawings which set forth illustrative embodiments which are indicative of the various ways in which the principles of the invention may be employed.

BRIEF DESCRIPTION OF THE DRAWINGS

For a better understanding of the padding system described hereinafter reference may be had to the following drawings in which.

DETAILED DESCRIPTION

Figure 1:
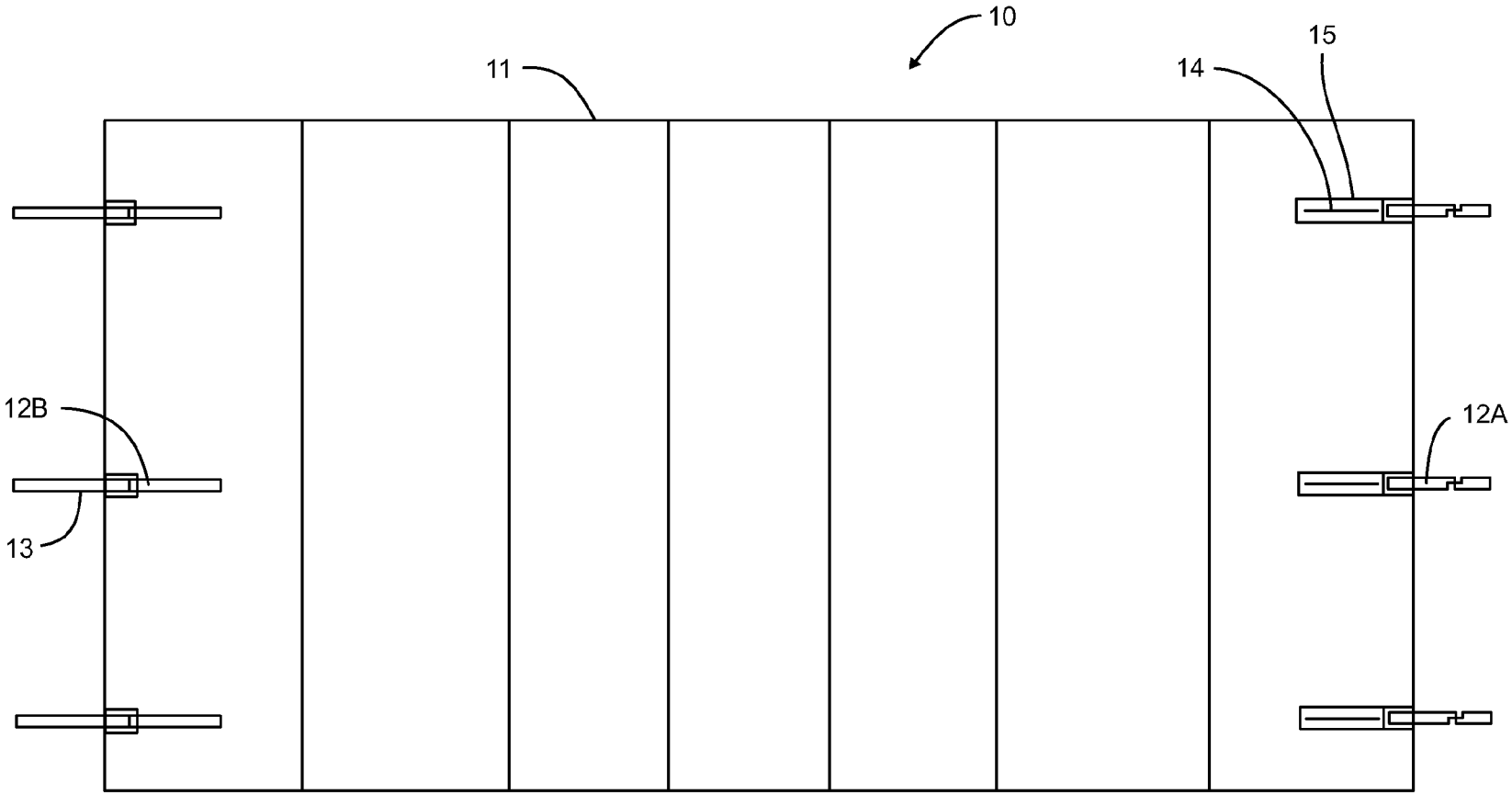
FIG. 1 is a front view of a first exemplary embodiment of a padding system constructed according to the invention.

Referring now to the figures, wherein like reference numerals refer to like elements, exemplary embodiments of a padding system 10 will now be described. As will become apparent, the padding system 10 is intended to be removably attached to a home appliance, such as a refrigerator, to thereby protect the home appliance, particularly an outer surface of the home appliance, when the home appliance is being moved in an unpacked state. To this end, the padding system 10 comprises a pad 11 having attached thereto one or more securing devices that function to releasably secure the pad 11 in a wrapped around arrangement relative to the outer surface of the home appliance. By way of example, the securing device comprises a strap 12*a* that is attached to, e.g., sewn to, the pad 11 at a location that is selected so as to allow the strap 12*a* to overlap with and releasably engage a receiving section 12*b* that is also attached to, e.g., sewn to, the pad 11 when the pad 11 is wrapped around the outer surface of the home appliance, i.e., the cooperating elements 12*a*/12*b* of the securing device are disposed on opposed ends of the pad 11. When the strap 12*a* and receiving section 12*b* are placed into such an overlapping relation, the strap 12*a* is releasably attached to the receiving section 12*b* as a result of the strap 12*a* (e.g., the back side of the strap 12*a*) and the receiving section 12*b* (e.g., the exposed front side of the receiving station 12*b*) being provided with complimentary fabric loop and plastic hook fasteners, e.g., "Velcro" brand fasteners. The strap 12*a*, which may be formed as a loop having a width of approximately two inches and length of approximately thirty inches, may additionally be provided with a leather backing on a side opposite to the side carrying the fasteners. While the securing device has been described as utilizing fabric loop and plastic hook fasteners, it will be appreciated that other releasable fastening systems, such as buttons, snaps, buckles, etc., may be also used in connection with the securing device to achieve the same results.

Figure 2:
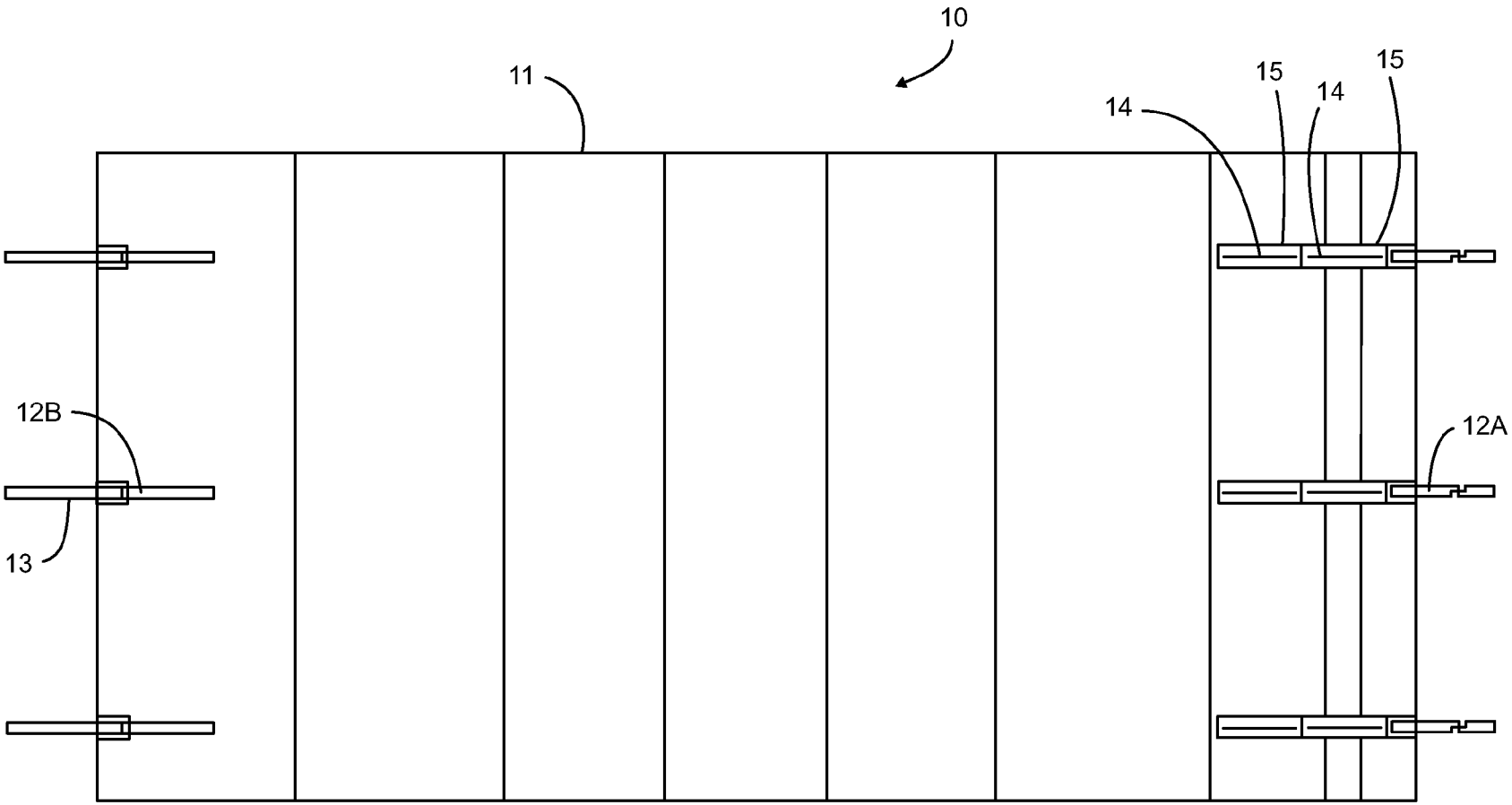
FIG. 2 is a front view of a second exemplary embodiment of a padding system constructed according to the invention.

The pad 11 is preferably constructed using a plurality of layers including a front cover layer, a back cover layer, an inner material layer, and an inner padding layer. The front cover layer, i.e., the layer to which the receiving station 12*b* is provided, and the back cover layer may be constructed using a two-hundred or higher deneir nylon fabric. The inner material layer may be constructed using an one-eighth inch thick polyester with felt backing material. The inner padding layer may be constructed using a three-eights inch thick felt material. The various layers may be sewn together around the periphery of the pad 11 as well as at interior locations of the pad 11, e.g., to provide panel like structures as shown in FIGS. 1 and 2. As shown in FIGS. 1 and 2, when panel like structures are provided, the inner padding layer may be selectively provided to various ones of the panels, e.g., only alternating ones of the panels will include the inner padding layer, to thereby provide the pad 11 with a higher degree of flexibility which is useful for wrapping the pad 11 about the outer surface of the appliance. As additionally shown in FIGS. 1 and 2, the overall shape and dimensions of the pad can be selected as needed for the appliance to be protected. Similarly, the materials used in the construction of the pad can be selected as needed.

Located on a side of the pad 11 opposite the side of the pad 11 to which the strap 12*a* of the securing device is attached, the pad 11 has attached thereto (e.g., sewn to) one or more hand straps 13. The hand strap 13, formed as a loop and constructed from a nylon material similar to strap 12*a*, is preferably sixteen inches in length and one inch wide. When the pad 11 is wrapped around the outer surface of the appliance, the hand strap 13 is intended to be drawn through a corresponding slit 14 formed in the pad 11. As illustrated in FIG. 1, the pad 11 may include a single slit 14 positioned adjacent to the strap 12*a* or, as illustrated in FIG. 2, the pad 11 may include plural slits 14 positioned adjacent to the strap 12*a*. In the embodiment illustrated in FIG. 2, the hand strap 13 may thus be drawn through either one of the plural slits 14. Surrounding the slit 14, e.g., formed as having a length of twelve inches, may be a leather backing pieces 15, having a length of fourteen inches and width of three inches, that would be attached to the front and back sides of the pad 11. In this manner, when the pad 11 is wrapped around and secured to the outer surface of the appliance, the hand strap(s) 13 extending from, i.e., drawn through, the slit(s) 14 may be grasped and used to assist in movement of the appliance.

While specific embodiments of a padding system have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalents thereof.

What is claimed is:

1. A padding system for protecting an outer surface of an appliance, comprising:

a pad;

a securing device attached to opposed first and second ends of the pad comprised of a first securing member that is releasably attachable to a second securing member when the pad is secured around the outer surface of the appliance; and a hand strap attached to the first end of the pad;

wherein the pad has a first slit positioned adjacent the second end of the pad whereby the hand strap is passable through the first slit to provide a hand grip when the pad is secured around the outer surface of the appliance.

2. The padding system as recited in claim 1, wherein the pad has a second slit positioned adjacent to the first slit whereby the hand strap is passable through one of the first slit and the second slit to provide a hand grip when the pad is secured around the outer surface of the appliance.

3. The padding system as recited in claim 1, comprising a plurality of securing devices attached to opposed first and second ends of the pad.

4. The padding system as recited in claim 3, comprising a plurality of hand straps attached to the first end of the pad wherein the pad has a plurality of first slits positioned adjacent to the second end of the pad whereby each of the plurality of hand straps is passable through a corresponding one of the plurality of first slits to provide a plurality of hand grips when the pad is secured around the outer surface of the appliance.

5. The padding system as recited in claim 1, comprising a backing member disposed around the first slit.

6. The padding system as recited in claim 1, wherein the pad comprises a plurality of pad panels.

7. The padding system as recited in claim 6, wherein the pad comprises a plurality of layers including a front layer, a back layer, and an intermediate padding layer.

8. The padding system as recited in claim 7, wherein the intermediate padding layer is included in less than all of the plurality of pad panels.

9. The padding system as recited in claim 1, wherein the first securing member comprises a strap having attached thereto one of fabric loop fasteners and plastic hook fasteners and the second securing member comprises the other of fabric loop fasteners and plastic hook fasteners.

10. The padding system as recited in claim 9, wherein the first slit is located adjacent to the first securing member and the hand strap is located adjacent to the second securing member.

11. The padding system as recited in claim 1, wherein the hand strap is formed as a loop to provide a hand grip when the pad is secured around the outer surface of the appliance.

12. The padding system as recited in claim 1, wherein the hand strap is operable to be grasped for assisting in movement of the appliance when the pad is secured around the outer surface of the appliance.

* * * * *